US008297344B2

(12) United States Patent
Vouche

(10) Patent No.: US 8,297,344 B2
(45) Date of Patent: Oct. 30, 2012

(54) MODULAR AIR-COOLED CONDENSER APPARATUS AND METHOD

(75) Inventor: Michel Vouche, Brussels (BE)

(73) Assignee: SPX Cooling Technologies, Inc., Overland Park, KS (US)

( * ) Notice: Subject to any disclaimer, the term of this patent is extended or adjusted under 35 U.S.C. 154(b) by 1146 days.

(21) Appl. No.: 12/171,218

(22) Filed: Jul. 10, 2008

(65) Prior Publication Data

US 2010/0006270 A1 Jan. 14, 2010

(51) Int. Cl.
*F28B 6/00* (2006.01)

(52) U.S. Cl. ..... 165/124; 165/122

(58) Field of Classification Search ..... 165/122, 165/124

See application file for complete search history.

(56) References Cited

U.S. PATENT DOCUMENTS 3,363,885 A * 1/1968 Meek ..... 261/30
3,707,277 A * 12/1972 Phelps ..... 261/23.1
5,067,560 A * 11/1991 Carey et al. ..... 165/124
6,382,310 B1 * 5/2002 Smith ..... 165/121

FOREIGN PATENT DOCUMENTS

WO 99/64794 12/1999
WO WO 9964794 A1 * 12/1999

* cited by examiner

*Primary Examiner* — Allen Flanigan
(74) *Attorney, Agent, or Firm* — Baker & Hostetler LLP

(57) ABSTRACT

An air-cooled condenser for receiving and condensing steam has at least one first, corner module and at least one second, intermediate module. The first module has a four-sided profile in plan view and a respective vertical tube bundle panel located on each of two adjacent sides of the first module. The second module has a four-sided profile in plan view and a vertical tube bundle panel on one of its sides, and an internal tube bundle panel disposed inside of the second module. Steam is supplied to all of the tube bundle panels.

14 Claims, 5 Drawing Sheets

MODULAR AIR-COOLED CONDENSER APPARATUS AND METHOD

FIELD OF THE INVENTION

The invention relates generally to the field of dry cooling apparatuses which are used to cool or condense steam by passing the steam through coils in contact with ambient air. Additionally the invention may be used to cool fluids.

BACKGROUND OF THE INVENTION

Various types of devices are in wide use in industry in order to cool a warm or hot material such as steam. For example, many industrial applications generate steam which is desirable to cool and condense before re-circulating back as water. Various apparatuses generally known as cooling towers or air cooled condensers have been used for this purpose. One category of these cooling towers are so-called dry cooling towers which contain some form of heat exchanger that is supported in the structure so that air is passed over the heat exchanger. In some examples known as air-cooled condensers, the steam is fed to so-called coil bundles or condenser panels, which can be for example panels having a number of parallel tubes in contact with the ambient air. As the steam passes through these coil panels, the steam gives off heat and eventually is condensed back into water which can be removed. The steam is desired to be cooled to a point where it will condense back into water, and can be removed from the condenser panels as water.

Some air-cooled condensers have been designed in a modular fashion, with the coil panels being oriented vertically on one or more perimeter outsides of the tower. Air is drawn into the tower by a central fan and this is drawn through the panels. In another arrangement, the coils are internal to the tower and are arranged in an A-shaped fashion so that steam enters a central header pipe that travels downward through the panels where it is condensed and removed by a header pipe at the bottom of each of the angled A-shaped panels.

In order to facilitate air travel through either arrangement of the tower, it has been known to provide fans, typically one large fan associated with each module in a modular system. In the perimeter type system, the fan is located above the vertical panels and thus is down stream of the panels, pulling the air through the panels in what is called induced draft. In the A-profile type arrangement, the fan deck is placed below the angled A-profile panels and pushes the air through the A-profile panels. Thus, the fan is upstream of the panels and pushes the air through the panels in what is described as a force draft.

The known designs have many desirable properties. However, it is always desirable to reduce the size cost and/or energy consumption of dry cooling towers.

SUMMARY OF THE INVENTION

Some embodiments of the present invention provide apparatuses and methods for providing dry cooling, utilizing a tower structure having coil panels located on at least part of the perimeter of the tower, as well as angled coils disposed inside at least a portion of the tower. The system may be provided by several modules, with some of the modules having perimeter panels, and at least some of the modules having interior coil panels as well. Further, in some embodiments, an interior air baffle may be provided to separate the air flow in a perimeter panel from that of an interior panel.

An air-cooled condenser receives and condenses steam where at least one first module has a four-sided profile in plan view, a pair of vertical first condenser tube bundle panels, with one respective vertical tube bundle panel located on each of two adjacent sides of the first module. The air-cooled condenser also receives and condenses steam in a second module which has a four-sided profile in plan view, a vertical second tube bundle panel located on one side of the second module, and an interior third tube bundle panel disposed inside of the second module.

Yet another embodiment describes an air-cooled condenser which receives and condenses steam and has at least one first cooling means, having a four-sided profile in plan view, and having a pair of vertical first condenser tube bundle panels, with one respective vertical tube bundle panel located on each of two adjacent sides of the first cooling means. The air-cooled condenser has a second cooling means, with a four-sided profile in plan view and a vertical second tube bundle panel located on one side of the second cooling means, and also has an interior third tube bundle panel disposed inside of the second cooling means.

A further embodiment includes an air-cooled condenser to receive and condense steam having at least one first module with a four-sided profile in plan view, a pair of vertical first condenser tube bundle condensing means wherein one respective vertical tube bundle condensing means is located on each of two adjacent sides of the first module. Still another embodiment describes the air-cooled condenser as having a second module, a four-sided profile in plan view, and a vertical second tube bundle condensing means located on one side of the second module, and an interior third tube bundle condensing means disposed inside of the second module.

In still another embodiment, a method is provided where the air-cooled condenser receives and condenses steam by drawing air through at least one first module having a four-sided profile in plan view and a pair of vertical first condenser tube bundle panels, with one respective vertical tube bundle panel located on each of two adjacent sides of the first module. The air-cooled condenser also draws air through a second module, having a four-sided profile in plan view, a vertical second tube bundle panel located on one side of the second module, and an interior third tube bundle panel disposed inside of the second module. Steam is supplied to the first and second modules.

Another embodiment provides an air-cooled condenser for receiving and condensing steam, using at least two cooling modules, each comprising four sides, with at least two of the sides supporting a tube bundle panel, wherein the modules are adjacent each other and air flow through the modules is separated by a common vertical cladding wall.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
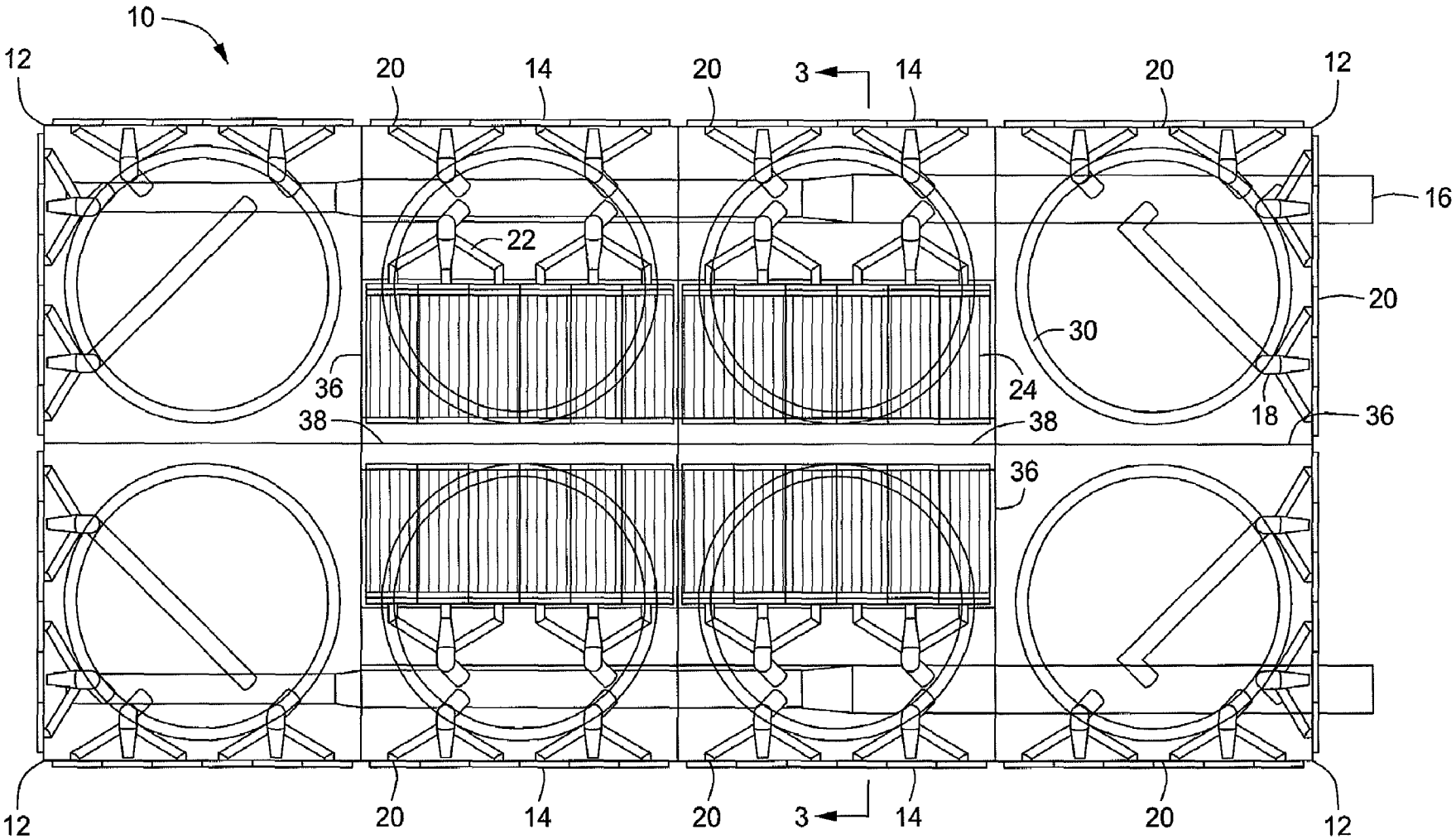
FIG. 1 is a schematic top view of a cooling apparatus according to a first embodiment of the present invention, utilizing eight modules arranged in two streets.

Some embodiments of the present invention provide apparatuses and methods for providing dry cooling, and, for example steam condensation, utilizing a tower structure having coil panels located on at least part of the perimeter of the tower, as well as angled coils disposed inside at least a portion of the tower. The system may be provided by several modules, with some of the modules having perimeter panels, and at least some of the modules having interior coil panels as well. Further, in some embodiments, an interior air baffle may be provided to separate the air flow in a perimeter panel from that of an interior panel. Some preferred embodiments will now be described with reference to the drawing figures, in which like reference numbers refer to like parts throughout.

Turning to FIG. 1, an example of a cooling apparatus is provided in the form of an air-cooled condenser (ACC) 10. This exemplary ACC 10 has four corner (or end) modules 12 and four central (or intermediate) modules 14. Thus, this system has a total of eight modules. These modules can be referred to as being arranged in two streets or rows. In this example, the corner modules are essentially the same as each other, other than being symmetrically opposite. Further, the intermediate modules 14 are also essentially the same as each other, other than being symmetrically opposite. Thus, only one each of the end modules 12 and intermediate modules 14 need be described at a time.

The cooling system 10 includes a steam supply system which includes two main supply pipes 16, one for each street. The main supply pipe 16 decreases in diameter as it gets farther from the supply in order to maintain a relatively constant supply velocity, as will be described further below. The main supply pipe 16 is connected to a number of perimeter headers 18, each of which supplies the steam to a respective set of perimeter coil panels 20. The coil panels 20 are grouped together next to each other to form larger coil panel sets. Each coil panel 20 has a number of parallel tubes, and in one embodiment the tubes may have fins or other heat transfer aids. The main steam pipe 16 also supplies steam to a number of interior steam headers 22 which supply steam to respective interior coil panels 24. The construction of coil tube panels 20 and 24 for air-cooled condensers itself is well known and thus is not described further. Any suitable coil panel design may be utilized in accordance with these embodiments.

Figure 2:
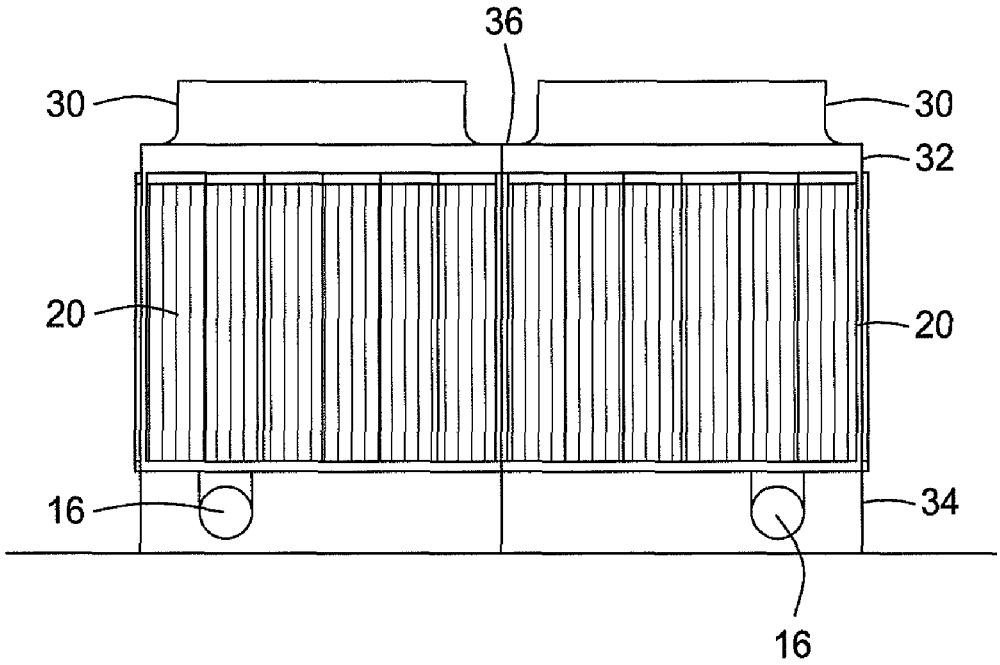
FIG. 2 is an end view of the apparatus of FIG. 1.

The arrangement and placement of the coil panels 20 and 24 are generally as follows. Each of the end modules 12 is square and thus is four-sided in plan view. Each end module 12 has two of its sides, its outer two sides, supporting vertical outer perimeter coil panels 20. The interior of the corner modules is otherwise open, and has at its top an exit fan (not shown) surrounded by an upper fan shroud 30. FIG. 2 also shows this configuration in an end view. The corner modules may also have some perimeter cladding 32 located above the coil panels 20 and lower cladding 34 below the coil panels 20. However, the lower cladding 34 may extend partly or all the way down to the ground surface. If lower cladding 34 extends only part of the way to the ground surface, then is necessary to provide horizontal cladding at the bottom elevation where the lower cladding 34 terminates to prevent entering air from bypassing coil panels 20 in the corner modules 12. It will be appreciated that as the fan 30 operates, it will draw air through the coil panels 20, with the air then being exhausted out the fan shroud 30. The steam is supplied by the headers to the top of the coil panels 20 and condenses as it falls through the coil panels and can be removed as water by a water removal system (not shown).

In the illustrated embodiment, the interior two sides of each module 12 feature vertical cladding 36 which runs the entire height of the module up to the fan shroud. Thus, each of the corner modules 12 is isolated from any neighboring corner modules 12 or intermediate modules 14. Substantially all the air flow into a corner module 12 is through a coil panel 20, and all of the air exits out of the fan shroud 30. Air is not intermixed inside the modules 12 with air from other modules.

Figure 3:
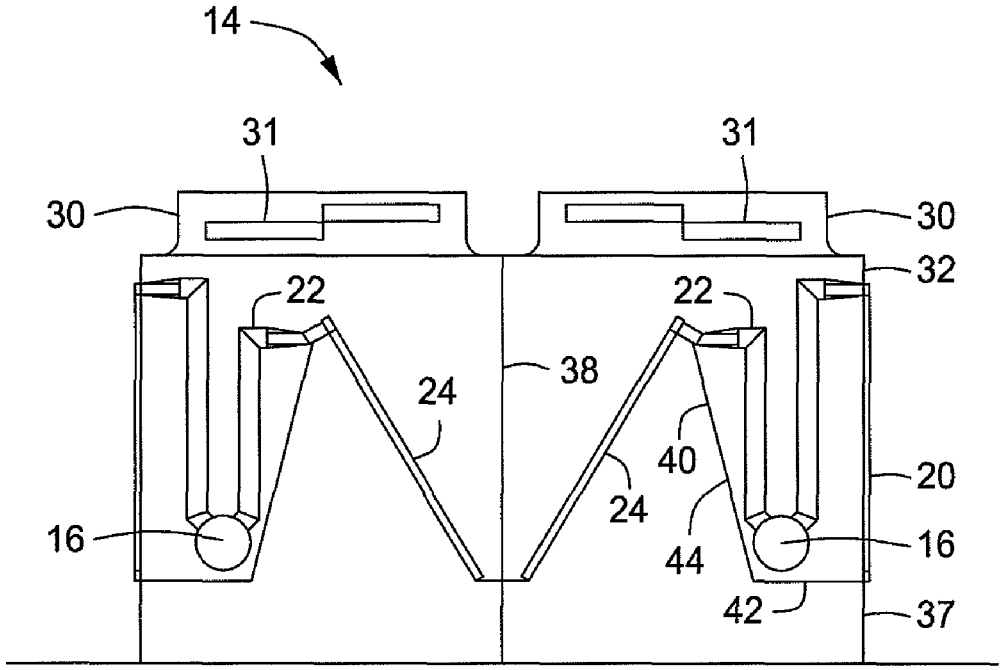
FIG. 3 is a cross-sectional view taken through line 3-3 in FIG. 1.

Turning next to the interior modules 14, these modules are also square and hence four-sided. The single outer perimeter side of the modules 14 has a vertical tube panel 20 which is similar in configuration to the exterior perimeter tube panels 20 of the corner modules 12. The perimeter side of the interior modules 14 may also have some upper and lower cladding 32 and 34, and the module 14 also has a fan (not shown) disposed in a fan shroud 30. However, as discussed further, the cladding 34 is either omitted or reduced on site to permit airflow underneath the coil panels 20. The intermediate modules 14 also feature an angled tube panel 24, as shown in FIGS. 1 and 3. The angled tube panel 24 receives steam from a header 22 at the top of the tube panel 24, and as the steam passes downwardly through the tube panel 24 it is condensed and is drawn from the tube panel 24 as water by a water removal system (not shown). In the case of an intermediate module 14, the vertical cladding 36 disposed below the outer perimeter vertical tube panel 20 (or beneath the lower cladding 34) is left open. This permits air to be drawn in through the open area 37 and through the inclined tube panel 24. The air is then drawn by the fan out through the fan shroud 30.

It will be appreciated that in the case of the intermediate modules 14, two air paths are provided. A first air path is air which enters the tube bundle 20, passes through the tube bundle 20, and is exhausted by the fan. A second air path is air which enters through the lower opening 37, passes through the tube bundle 24, and is exhausted by the fan.

In some preferred embodiments, it is desirable to separate these air streams by a sloped internal cladding 40, as shown. In the example of FIG. 3, the sloped internal cladding 40 includes a horizontal section 42 and an inclined section 44. It will be appreciated that by providing the internal cladding 40, air which enters the tower passes through only one or the other of the tube bundles 20 or 24. After passing through the tube bundles 20 or 24, the air is able to intermix to some degree as it is exhausted by the fan 31.

Each of the intermediate modules 14 is also isolated from each other, and from the corner modules 12, by having vertical cladding on each of its three interior sides. In the example shown, each of the intermediate modules 14 has two of its sides isolated by vertical cladding 36, and its fourth side isolated by vertical cladding 38. The vertical cladding 38 is structurally the same as the vertical cladding 36, but is identified by a separate reference number for clarity.

Figure 4:
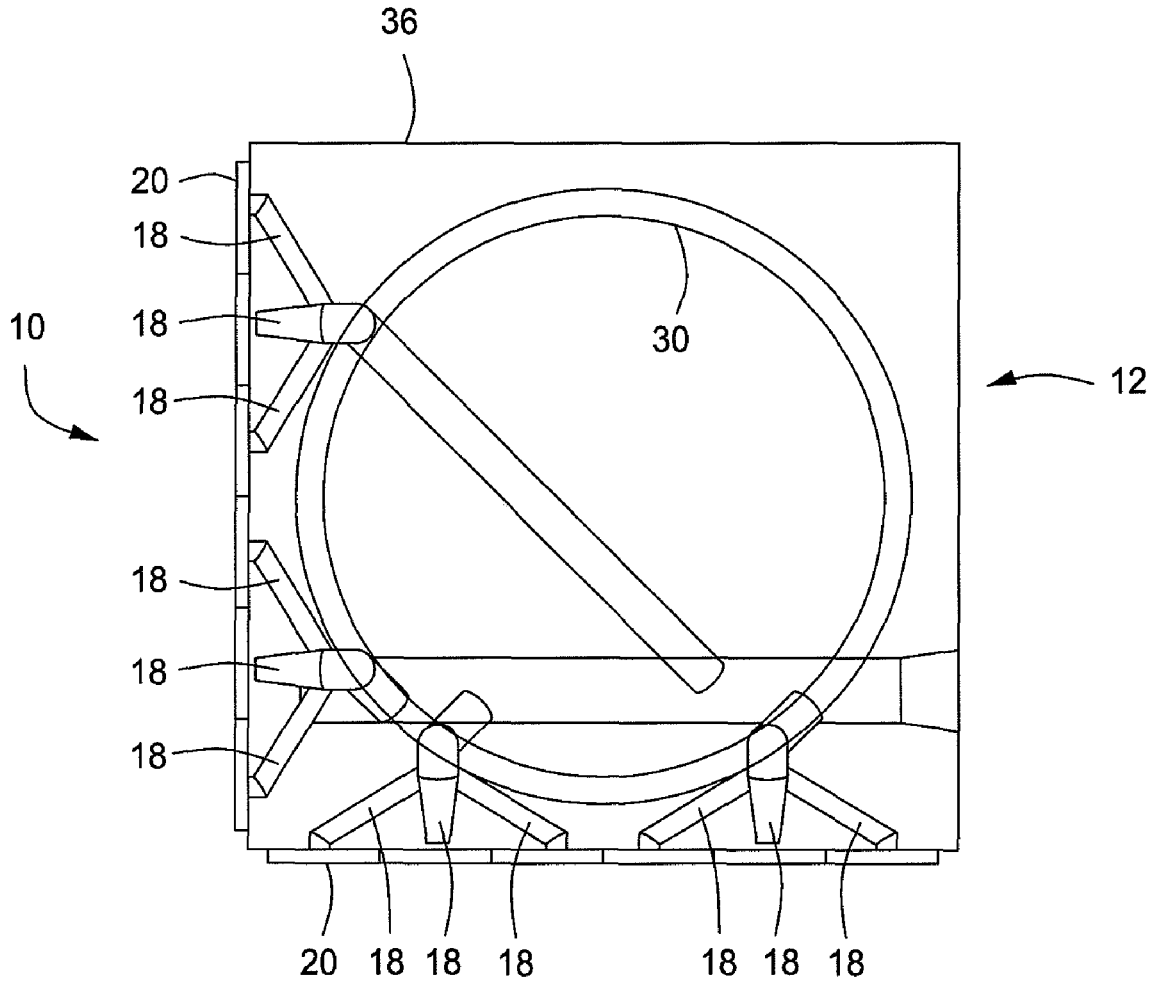
FIG. 4 is a view of a corner module according to FIG. 1.

FIG. 4 is a view of a corner module 12 according to FIG. 1, but larger in size to permit reference numbers.

Figure 5:
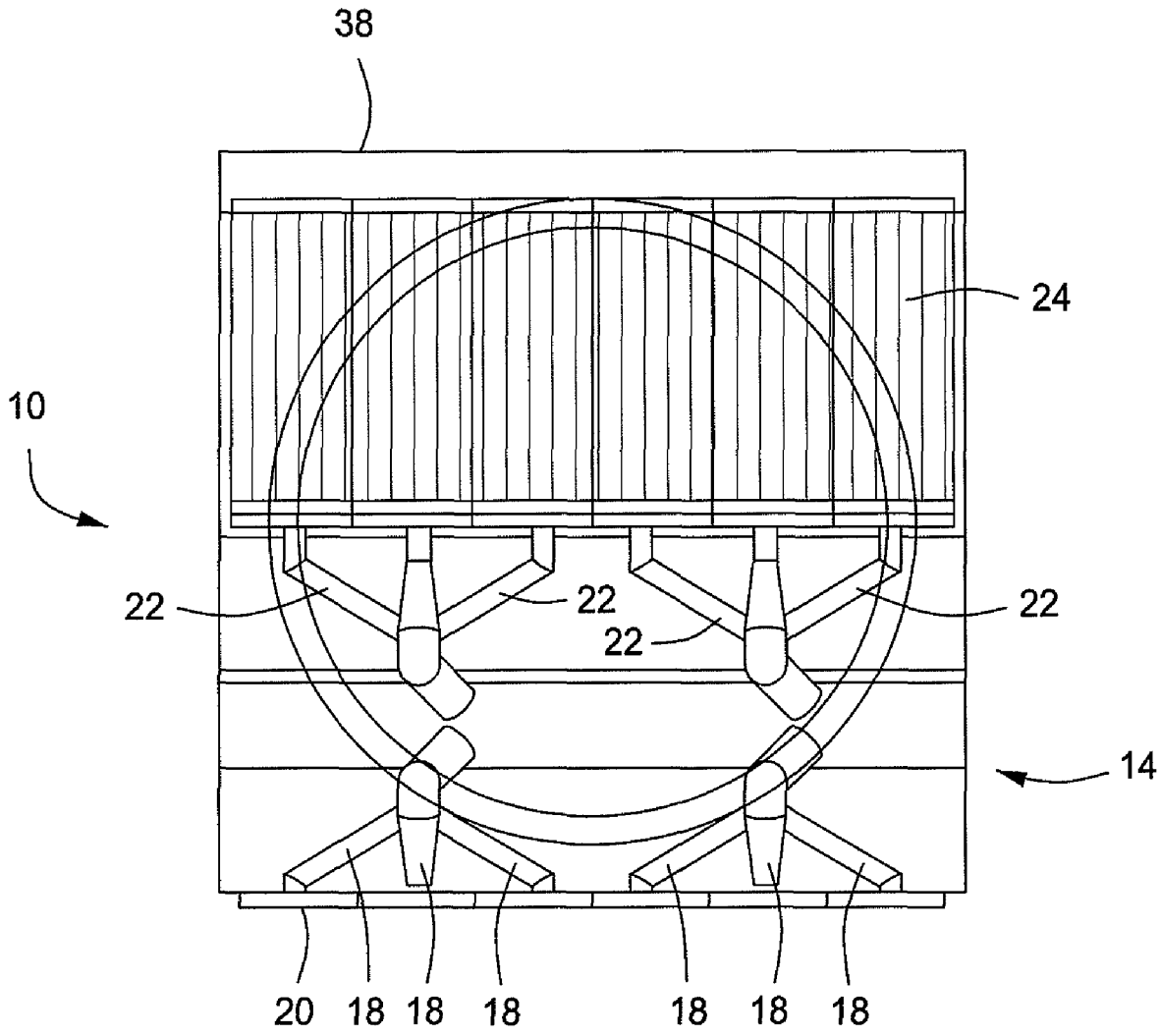
FIG. 5 is a view of an intermediate module according to FIG. 1.

FIG. 5 is a view of an intermediate module 14 according to FIG. 1, but larger in size to permit reference numbers.

It will be appreciated that the illustrated embodiment provides a induced draft tower, in that the air is drawn by the fan through the coil panels as opposed to being pushed through the coil panels. This design is sometimes more efficient than a forced draft system.

Further, the illustrated example provides a system wherein the outer corner modules take advantage of their two-sided perimeter in order to have two coil panels. The interior modules 14, which have only one exposed side for a coil panel, nevertheless are able to gain square footage of heat exchange surface approximately equal to two panels worth of square footage, by providing one vertical panel in the perimeter wall, and a second panel inclined and inside of the intermediate module. Thus, a fan which is scaled for a corner module, and is designed to draw air through the square footage of two panels, can also essentially be used in an intermediate module 14, where it will also draw air through tube panels (one on the perimeter and one on the inside).

It will be appreciated that this arrangement can provide many benefits. For example, each of the square modules can be expected to provide essentially the same heat transfer load, using essentially the same fan and power requirement. Further, using only two types of modules, a complete system can be designed using parallel streets with any number of corner and intermediate modules. That is, although the example uses eight modules, four of each type, it will readily be appreciated that a longer system could be designed simply by inserting more intermediate modules in line. Further, while a two-street system is often preferred, a single street can be constructed from the disclosed modules.

Figure 6:
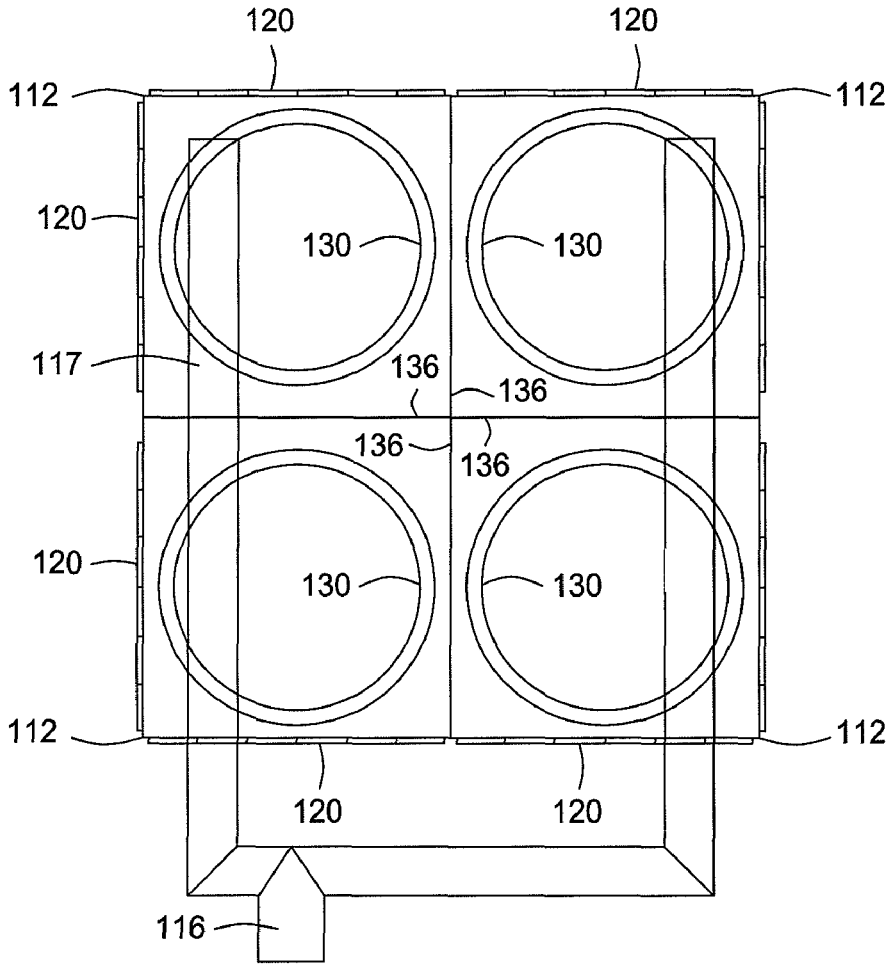
FIG. 6 is a schematic top view of a cooling apparatus according to a second embodiment, utilizing four modules.
Figure 7:
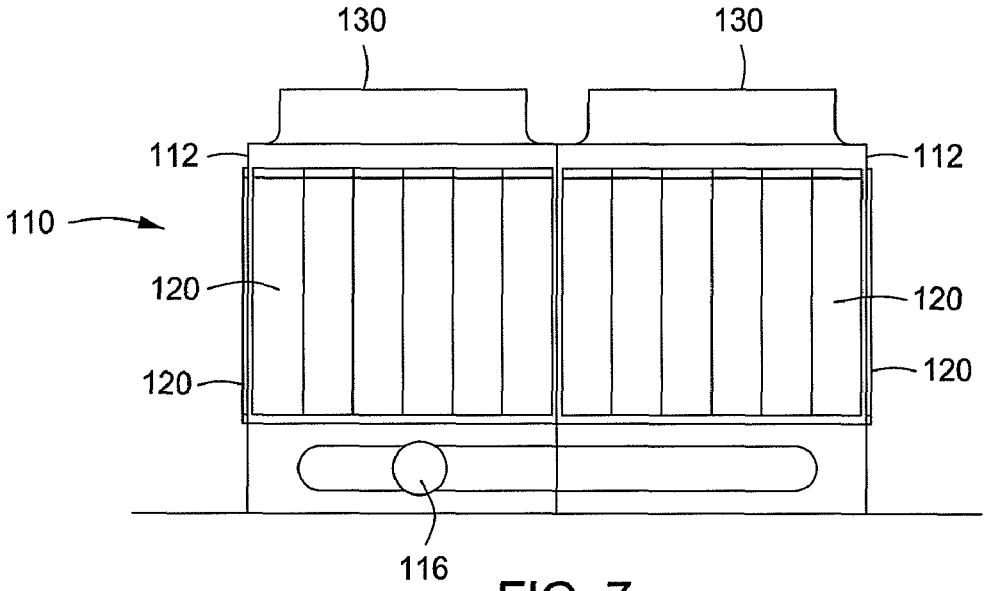
FIG. 7 is an end view of the apparatus of FIG. 6.

FIGS. 6 and 7 show a second embodiment of the invention, in the form of a square, four-module tower 110. The tower 110 includes four modules 112, each of which have perimeter coil panels 120 on two of their sides. The modules 112 are substantially the same as the modules 12 described with regard to the first embodiment, and thus have upper fan shrouds 130, and internal vertical cladding 136. A main steam supply 116 has two branches 117 that provide steam to all of the perimeter coil panels 120. The header system that feeds each perimeter coil panel 120 is omitted from FIG. 6 for simplicity of illustration. However, branch headers are used for this purpose which are similar to the perimeter headers 18 described with respect to the first embodiment. The vertical cladding 136 isolates the air flow in each of the four modules 112 from each other.

From the two embodiments shown, it will further be appreciated that a wide variety of numbers of corner modules and/or intermediate modules may be arranged in a wide range of geometric configurations. Both of the illustrated embodiments utilize two streets touching each other, other shapes are possible, and for example two modules each having coil panels on three of their sides could be placed next to each other in a single street with a single internal vertical cladding separating the two modules.

In the two illustrated embodiments, the modules themselves are square or substantially square in plan view. However, any of the modules may be elongated into a rectangular shape. One such rectangular shape for a module would be to place two perimeter coil panels on a single side of the module. In the case of an interior module, the module can be made rectangular by having two perimeter coil panels and two interior coil panels.

In the illustrated embodiment of FIGS. 1-5, the interior coil panels 24 are inclined relative to the horizontal. However, it will be appreciated that in other embodiments the interior coil panel could be oriented in any spatial direction. For example, an interior coil panel could be placed nearly or substantially horizontally, or nearly or substantially vertically inside the module. Depending on the arrangement of the interior coil panel, baffling is shaped to serve the function of isolating the air through the interior coil panel from the air flowing through the perimeter coil panel.

References in the specification and claims to the word "rectangular" are intended to cover four-sided arrangements including squares, and where the four-sided arrangements are elongated (i.e., having some sides longer than the other sides). Although rectilinear or orthogonal four-sided modules are shown, it will be appreciated that the modules can be in the form of angled parallelograms if desired.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An air-cooled condenser apparatus for receiving and condensing steam, comprising:

at least one first module, having a rectangular profile in plan view, and having a pair of vertical first condenser tube bundle panels, with one respective vertical tube bundle panel located on each of two adjacent sides of the first module; and at least one second module, having a four-sided profile in plan view, and having a vertical second tube bundle panel located on one side of the second module, and an internal third tube bundle panel disposed inside of the second module, wherein the second module further comprises an air baffle in between the vertical second tube bundle panel and the inclined third tube bundle panel so that air entering the second module passes through only one or the other of the vertical second tube bundle panel or the inclined third tube bundle panel.

2. The apparatus according to claim 1, further comprising a steam supply pipe and a manifold that supplies steam to all of the tube bundle panels.

3. The apparatus according to claim 1, wherein the first module and the second module are mounted adjacent each other and share a common side, with the common side having cladding to separate the air flow path of the first module from the air flow path of the second module.

4. The apparatus according to claim 1, wherein both of the first and second modules have a respective fan located at the top of the module to exhaust air out of the module.

5. The apparatus according to claim 4, wherein the fans are located at an elevation above all the tube bundle panels.

6. The apparatus according to claim 1, wherein the apparatus comprises four first modules and four second modules, arranged in two adjacent rows, with the first modules located on the end of the rows, and the second modules located next to each other in between the first modules, so that each row has, in order, a first module, a second module, another second module, and another first module.

7. The apparatus according to claim 1, wherein the internal third tube bundle panel is inclined relative to horizontal.

8. An air-cooled condenser apparatus for receiving and condensing steam, comprising:

at least one first cooling means, having a rectangular profile in plan view, and having a pair of vertical first condenser tube bundle panels, with one respective vertical tube bundle panel located on each of two adjacent sides of the first cooling means; and at least one second cooling means, having a four-sided profile in plan view, and having a vertical second tube bundle panel located on one side of the second cooling means, and having an internal third tube bundle panel disposed inside of the second cooling means, wherein the second cooling means further comprises an air baffle in between the vertical second tube bundle panel and the inclined third tube bundle panel so that air entering the second cooling means passes through only one or the other of the vertical second tube bundle panel or the inclined third tube bundle panel.

9. The apparatus according to claim 8, wherein the internal third tube bundle panel is inclined relative to horizontal.

10. The apparatus according to claim 8, further comprising a steam supply pipe and a manifold that supplies steam to all of the tube bundle panels.

11. The apparatus according to claim 9, wherein the first cooling means and the second cooling means are mounted adjacent each other and share a common side, with the common side having cladding to separate the air flow path of the first cooling means from the air flow path of the second cooling means.

12. The apparatus according to claim 9, wherein both of the first and second cooling means have a respective fan located at the top of the cooling means to exhaust air out of the cooling means.

13. The apparatus according to claim 12, wherein the fans are located at an elevation above all the tube bundle panels.

14. The apparatus according to claim 9, wherein the apparatus comprises four first cooling means and four second cooling means, arranged in two adjacent rows, with the first cooling means located on the end of the rows, and the second cooling means located next to each other in between the first cooling means, so that each row has, in order, a first cooling means, a second cooling means, another second cooling means, and another first cooling means.

* * * * *